US005271472A

United States Patent [19]

Leturno

[11] Patent Number: 5,271,472

[45] Date of Patent: Dec. 21, 1993

[54] DRILLING WITH CASING AND RETRIEVABLE DRILL BIT

[75] Inventor: Richard E. Leturno, Plano, Tex.

[73] Assignee: Atlantic Richfield Company, Los Angeles, Calif.

[21] Appl. No.: 960,667

[22] Filed: Oct. 14, 1992

Related U.S. Application Data

[62] Division of Ser. No. 744,859, Aug. 14, 1991, Pat. No. 5,197,553.

[51] Int. Cl.[5] ..... E21B 4/00

[52] U.S. Cl. ..... 175/107; 175/267

[58] Field of Search ..... 175/62, 69, 73, 76, 175/85, 94, 93, 99, 230, 320, 107, 267

[56] References Cited

U.S. PATENT DOCUMENTS

| | | | |
|---|---|---|---|
| 1,833,134 | 11/1931 | Stokes | 175/259 |
| 3,603,412 | 9/1971 | Kammerer | 175/260 |
| 4,153,121 | 5/1979 | Allan | 175/266 X |
| 4,470,470 | 9/1984 | Takano | 175/261 X |
| 4,550,392 | 10/1985 | Mumby | 175/45 X |
| 4,616,719 | 10/1986 | Dismukes | 175/94 |
| 4,646,856 | 3/1987 | Dismukes | 175/107 |
| 4,651,837 | 3/1987 | Mayfield | 175/260 |
| 5,064,006 | 11/1991 | Waters et al. | 175/61 X |

*Primary Examiner*—Ramon S. Britts
*Assistant Examiner*—Roger J. Schoeppel
*Attorney, Agent, or Firm*—Michael E. Martin

[57] ABSTRACT

Wellbores are formed in the earth with elongated, tubular drillstems which include retrievable bit assemblies. The retrievable bit assembly includes a body having locking dogs engageable with cooperating recesses formed in a sub at the bottom of the drillstem. The bit assembly includes radially extendable and retractable arms with cutters thereon for forming the wellbore to a diameter greater than the drillstem, but whereby the arms may be retracted to withdraw the bit assembly through the drillstem with wireline retrieval apparatus or the like. The wellbore may be drilled with a tubular drillstem comprising wellbore casing with a bit connected to the lower end of the drillstem and retrievable through the drillstem by the wireline retrieval apparatus whereby the casing may be left in the wellbore upon completion of drilling operations.

4 Claims, 2 Drawing Sheets

DRILLING WITH CASING AND RETRIEVABLE DRILL BIT

This is a division, of application Ser. No. 07/744,859, filed Aug. 14, 1991 now U.S. Pat. No. 5,197,553, issued Mar. 30, 1993.

BACKGROUND OF THE INVENTION

1. Field of the Invention

The present invention pertains to a drilling assembly and method wherein the drill bit, a bit-drive motor and measurement-while-drilling or logging-while-drilling instruments are retrievable through the drillstem and the drillstem itself may be left in the wellbore to serve as the casing or wellbore liner.

2. Background

Conventional rotary drilling operations require relatively frequent withdrawal of the elongated sectionalized drillstem or "drillstring" from the wellbore to inspect or replace the drill bit or portions of the drillstem, to perform well logging operations and to install permanent well casing. This insertion and withdrawal process is time-consuming, hazardous to operating personnel and increases the possibility of damaging the well due to inadvertent dropping of the drillstring into the wellbore or encountering the influx of formation fluids into the wellbore due to the swabbing effect encountered during the drillstring insertion and removal process.

To overcome these problems and hazards, certain techniques have been proposed for drilling with retrievable bits and with drillstring arrangements wherein a liner or casing is inserted into the wellbore coextensively with the drillstem and drilling bit. British Published Patent Application 2,216,926A to Jumblefierce Limited describes a lining or casing assembly which is advanced through the wellbore which is being formed independently by a drill bit connected to a drillstem which extends through the casing and is advanced simultaneously with the casing. U.S. Pat. No. 4,651,837 to W. G. Mayfield describes a retrievable drill bit which may be inserted in and retrieved through a drillstem. However, the simultaneous advance of both the casing and drillstem has certain shortcomings with respect to complications in making up the joints between the drillstem sections and the casing sections, the added weight of the double stem and other complications of using double-stem components. Accordingly, the objective remains to significantly reduce the cost of drilling and installing casing when using any one of known drilling fluid mediums for drill cutting removal and the like, which is at least one of the objectives met by the present invention.

SUMMARY OF THE INVENTION

The present invention provides an improved method of drilling a well by utilizing a liner or casing as the drillstem in combination with a retrievable bit or a retrievable bit and downhole bit-drive motor assembly and retrievable measurement-while-drilling (MWD) and/or logging-while-drilling (LWD) devices.

In accordance with one important aspect of the present invention, a method of drilling a well is provided wherein the drillstem is advanced through the formation being drilled by a retrievable bit which has radially-movable cutter means to provide a borehole sufficiently larger than the maximum diameter of the drillstem so as to provide a suitable cuttings evacuation annulus and sufficient space for receiving cement to isolate formation regions and to fix the combined drillstem/casing in place when drilling operations are complete. By utilizing the well casing as the drillstem, expensive and hazardous insertion and retrieval operations are minimized.

In accordance with another important aspect of the present invention, there is provided a unique retrievable bit and retrievable bit and motor assembly for use in well drilling operations wherein retrieval of the drillstem for bit repair or replacement is eliminated and wherein the drillstem may be left in the wellbore to function as a wellbore casing or liner.

The present invention still further provides a unique retrievable bit drive motor and bit assembly which may be inserted in and retrieved from a wellbore through the drillstem which may or may not be left in the wellbore and utilized as the wellbore casing or liner. Thanks to the arrangement of the present invention, expensive and hazardous "tripping" in and out of the drillstring may be eliminated during bit and drive motor maintenance and replacement operations. Wellbore washouts, fluid influxes due to drillstem swabbing effects and drillstring failures may be minimized. The drilling, formation evaluation and casing installation processes may be combined into essentially one operation and the chances of stuck drillstrings, failed fishing operations or abandonment of a wellbore are all eliminated. The invention significantly reduces the cost of drilling a wellbore in operations such as oil and gas reservoir development.

Those skilled in the art will recognize the above-described features and advantages of the present invention together with other superior aspects thereof upon reading the detailed description which follows in conjunction with the drawing.

DESCRIPTION OF PREFERRED EMBODIMENTS

Figure 1:
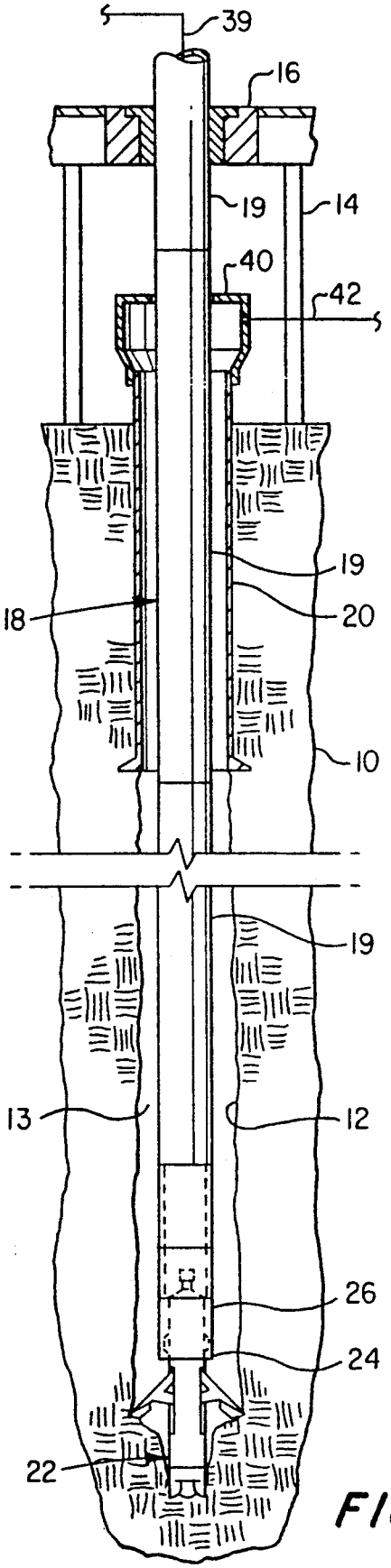
FIG. 1 is a vertical section view in somewhat schematic form of a wellbore being drilled by the method and apparatus of the present invention.

In the description which follows, like parts are marked throughout the specification and drawing with the same reference numerals, respectively. The drawing figures are not necessarily to scale and certain features are shown in generalized or schematic form in the interest of clarity and conciseness.

Referring to FIG. 1, there is illustrated an earth formation 10 into which a wellbore 12 is being formed by a drilling assembly and method in accordance with the present invention. The wellbore 12 is being formed utilizing a conventional drilling rig 14, partially shown in FIG. 1, including a rotary drive mechanism comprising so-called rotary table 16 which is adapted to rotatably drive a drillstem, generally designated by the numeral 18. The wellbore 12 is shown already partially cased by a surface casing 20.

The wellbore 12 is being formed in accordance with the present invention by a unique rotary drill bit assembly 22 connected to the lower end 24 of the drillstem 18 in a unique manner. The bit assembly 22 is adapted to be retrieved from the wellbore 12 through the interior of the drillstem 18 without removing the drillstem from the wellbore. The drillstem 18 is made up of end-to-end coupled tubular pipe or casing sections 19 which may be threadedly connected to each other in a conventional manner using conventional coupling or threaded end parts known to those skilled in the art of well drilling. The drillstem 18 is suspended in the wellbore 12 by conventional means associated with the drilling rig 14, not shown. In accordance with an important aspect of the present invention, the coupled tubular drillstem sections 19 may, in fact, comprise wellbore casing or liner which may be left in the wellbore and not retrieved or removed from the wellbore upon completion of drilling or for changing or replacing the bit assembly 22. In this regard the bit assembly 22 is required to have cutting means thereon which are operable to form the wellbore 12 to a diameter larger than the diameter of the drillstem 18 but which cutting means may be adapted to permit the bit assembly 22 to be secured in its working position shown in FIG. 1 and retrieved from its working position for replacement or repair without withdrawing the drillstem 18 from the wellbore.

The bit assembly 22 may be inserted in and withdrawn from the drillstem 18 utilizing conventional equipment for lowering and retrieving a wireline, braided line or electric logging cable, not shown in FIG. 1. Alternatively, a conventional workstring or coiled tubing equipment, also not shown in FIG. 1, may be used. In order to provide for insertion of and retrieval of the bit assembly 22 with respect to its working position without withdrawing the drillstem 18 from the wellbore 12, the lower end of the drillstem is preferably provided with a sub 26 which is modified to receive and secure the bit assembly to the lower end of the drillstem.

Figure 2:
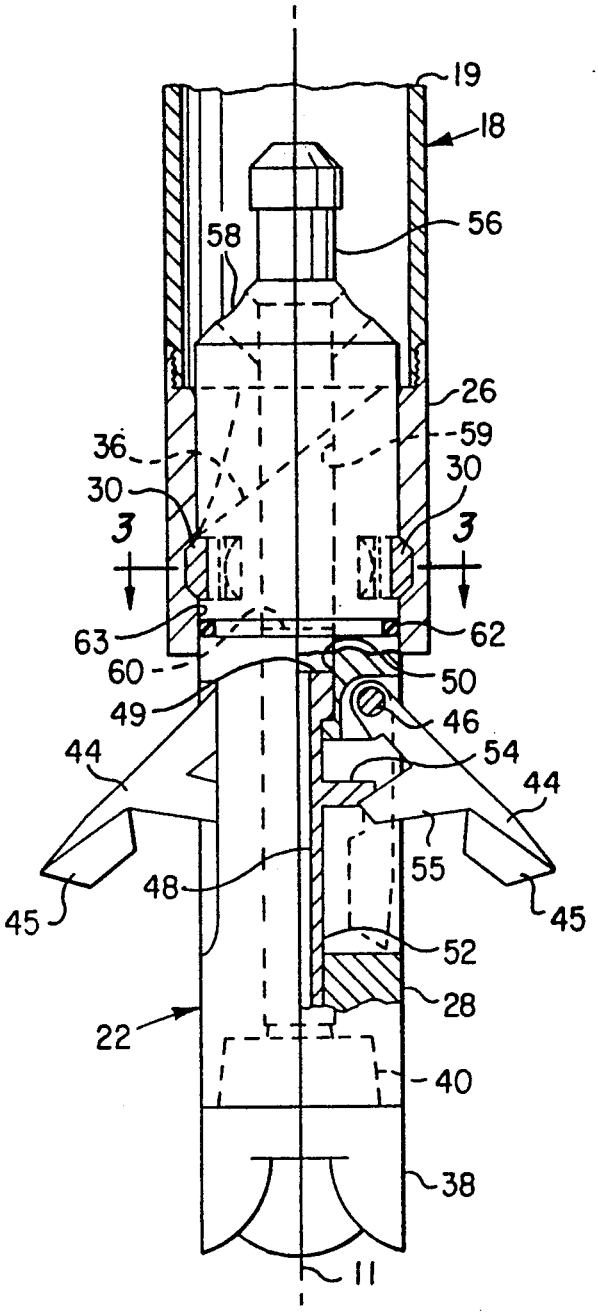
FIG. 2 is a detail view showing one embodiment of a retrievable bit assembly in accordance with the present invention.
Figure 3:
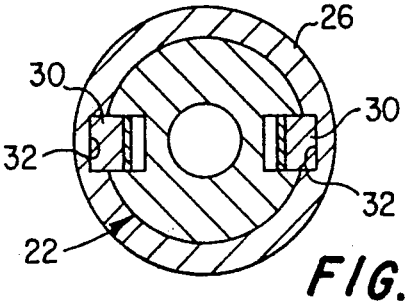
FIG. 3 is a section view taken along the line 3—3 of FIG. 2.

Referring to FIG. 2, there is illustrated some additional detail of the drillstem 18 including the sub 26 which is threadedly connected to the lower-most drillstem section 19. The bit assembly 22, in a preferred embodiment, includes a body 28 on which suitable radially-movable locking dogs 30 are disposed and are movable into a position to lock the bit assembly 22 to the sub 26 to prevent axial or rotational movement of the body 28 with respect to the sub 26 so that drilling operations may be carried out. In this regard, opposed recesses or slots 32, FIG. 3, are formed in the bore 34 of the sub 26 for receiving the locking dogs 30. The dogs 30 may be spring-biased radially outwardly into their locking positions or may be hydraulically or electrically actuated between locked and unlocked positions. The sub 26 may be provided with opposed axially-extending curved recesses 36, one shown in FIG. 2, for guiding the locking dogs 30 into the recesses 32 in the positions illustrated. Additional dogs 30 or similar key means may be provided to bear the reaction forces created by rotation of the bit.

The bit assembly 22 also comprises a removable bit member 38 which is connected to the lower end of the body 28 in a conventional manner by a threaded pin-and-box connection 40. The bit 38 has a maximum diameter which permits insertion of and removal of the bit assembly 22 through the bore 34 of the sub 26 and, of course, the entirety of the drillstem 18. The bit 38 may be a conventional rotary drill bit of the roller-cone type or of the so-called PDC type and is provided with suitable passages, not shown, for ejection of drilling fluid from the bit into the wellbore 12 from the drillstem 18 and to flow up the annular area 13 formed between the drillstem 18 and wellbore wall, FIG. 1. Drilling fluid is conveyed into the drillstem 18 by way of a suitable conduit 39 through conventional means, not shown, and is returned to a drill cuttings separation and drilling fluid treatment system, not shown, by way of a conventional bell nipple 40 and conduit 42.

Referring further to FIG. 2, the retrievable bit assembly 22 further includes one or more arms 44 pivotally supported on the body 28 and movable between a retracted position within the circumferential envelope of the body 28 and a radially-extended, hole-cutting position illustrated in FIGS. 1 and 2. The arms 44 are radially extendable with respect to the drillstem central longitudinal axis 11. Each arm 44 is pivotally supported on the body 28 at pivot means 46 and is movable to the extended, working position by an axially movable piston 48 disposed in a bore 50 formed in the body 28. The piston 48 includes a stem portion 52 comprising a conduit for conducting drilling fluid through the body 28 to the bit 38. The stem portion 52 includes a suitable transverse, flange-type cam 54 formed thereon and engageable with a cam follower 56 on the arm 44 to move the arm to the position shown in response to pressure drilling fluid acting on the piston face 49. The arm 44 includes suitable cutter means 45 formed thereon for cutting or enlarging the wellbore 12 to a diameter greater than that which can be cut by the bit 38.

The bit assembly 22 further includes suitable means for connecting the bit assembly to a retrieval device which, by way of example, comprises a so-called fishing neck 56 formed on the upper end of the body 28. One or more fluid ports 58 open from the exterior of the body 28 into a passage 59 in communication with the bore 50. A frangible closure member 60 may be disposed in the bore 50 above the piston 48 to prevent fluid from acting thereon until a certain fluid pressure in the drillstem 18 is provided so as to prevent premature deployment of the arms 44 into their radially-extended operating positions illustrated in FIG. 2. In this way, the bit assembly 22 may be inserted into the drillstem 18 and pumped down into locking engagement with the sub 26 by pressure fluid acting on the bit assembly.

The bit assembly 22 may also be conveyed to its working position through the drillstem 18 and retrieved therefrom using a conventional wireline-conveyed fishing tool, not shown in FIG. 1, and which may include a jar assembly, not shown, for use in the retrieval operations. For example, assuming that the drillstem 18 extends within the wellbore 12 with the bit assembly 22 already connected thereto in the manner shown in FIG. 2, the pressure of drilling fluid being injected into the drillstem by way of the conduit 39 may be increased until the frangible closure 60 ruptures to allow pressure fluid to act on the piston 48 to urge the arms 44 into their radially-extended and working position. Drilling may then be carried out in a conventional manner by rotating the drillstem 18 and adding sections 19 to the drillstem as it extends into the earth. Drilling fluid is circulated through the drillstem 18 in a conventional manner through the body 28 and the bit 38 and then up through the annulus 13 for treatment and recirculation.

During drilling operations all conventional parameters such as weight on bit, drillstem rotation speed, rate of penetration and other parameters normally monitored, would be relied on to indicate if the bit 38 was becoming excessively worn or broken whereupon, in such event, drilling would cease. If required, the wellbore 12 would then have drilling fluid circulated therethrough until it was "clean". The retrievable bit assembly 22 would then be retrieved from the drillstem 18 in the following manner. The drillstem 18 would be pulled uphole until the bit assembly 22 was off the bottom of the wellbore a short distance. A conventional wireline unit, not shown in FIG. 1, would then be brought into position for insertion in the drillstem 18 in a conventional manner and a suitable fishing tool, such as the type described in U.S. Pat. No. 4,856,582 to Smith et al and assigned to the assignee of the present invention, would be lowered on an electric line into the interior of the drillstem and latched onto the fishing neck 56. The locking dogs 30 would then be retracted and the bit assembly 22 pulled out of the sub 26 and up through the drillstem for inspection, repair or replacement.

If needed, a new bit assembly 22 would then be connected to the aforementioned electric line or a wireline and lowered through the drillstem 18 with the assistance of drilling fluid to "pump" the bit assembly down into the sub 26. A suitable fluid seal, which might comprise a metal-to-metal seal, not shown, or an elastomer-type seal, such as an O-ring 62, is preferably formed on the exterior of the bit body 28 and moves into sealing engagement with a slightly reduced diameter bore 63 of the sub 26 when the locking dogs 30 have locked into the recesses or keyways 32. As the bit assembly 22 moves into the bore of the sub 26, the dogs 30 will be guided by the grooves 36 until they are aligned with and locked into the recesses 32 so that the drillstem 18 and the bit assembly will rotate and move axially together. As previously mentioned, the locking dogs 30 may be hydraulically or electrically extended and retracted with suitable mechanism, not shown, and controlled from the surface by the wireline unit mentioned above. Alternatively, the dogs 30 may be heavily spring-biased into their locking positions in the recesses 32 and, subject to a suitable axial pulling force, be "cammed out" of the recesses 32 when it is desired to retrieve the bit assembly 22.

Once the new bit assembly 22 is installed in the sub 26, pressure of the drilling fluid is increased to rupture the frangible closure member 60 so that the piston 48 may actuate the arms 44 to extend the cutters 45 into the working positions shown in FIGS. 1 and 2. Drilling operations may then resume after the drillstem 18 is lowered back into its working position.

Upon completion of drilling of the wellbore 12, if the drillstem 18 is to serve as a wellbore casing or liner, the bit assembly 22 is retrieved from the drillstem 18 in the same manner as described above and the drillstem is left in the wellbore to be secured in place by installation of an appropriate casing shoe device and then injection of cement into the annulus 13 in a conventional manner. The upper end of the drillstem 18 would, of course, be cut off and installed in a suitable well head member, not shown, also in a conventional manner.

If the drillstem 18 is to be withdrawn from the wellbore, then the bit assembly 22 will, of course, not be required to be retrieved in the manner described above but may be withdrawn connected to the lower end of the drillstem in a conventional manner.

Figure 4:
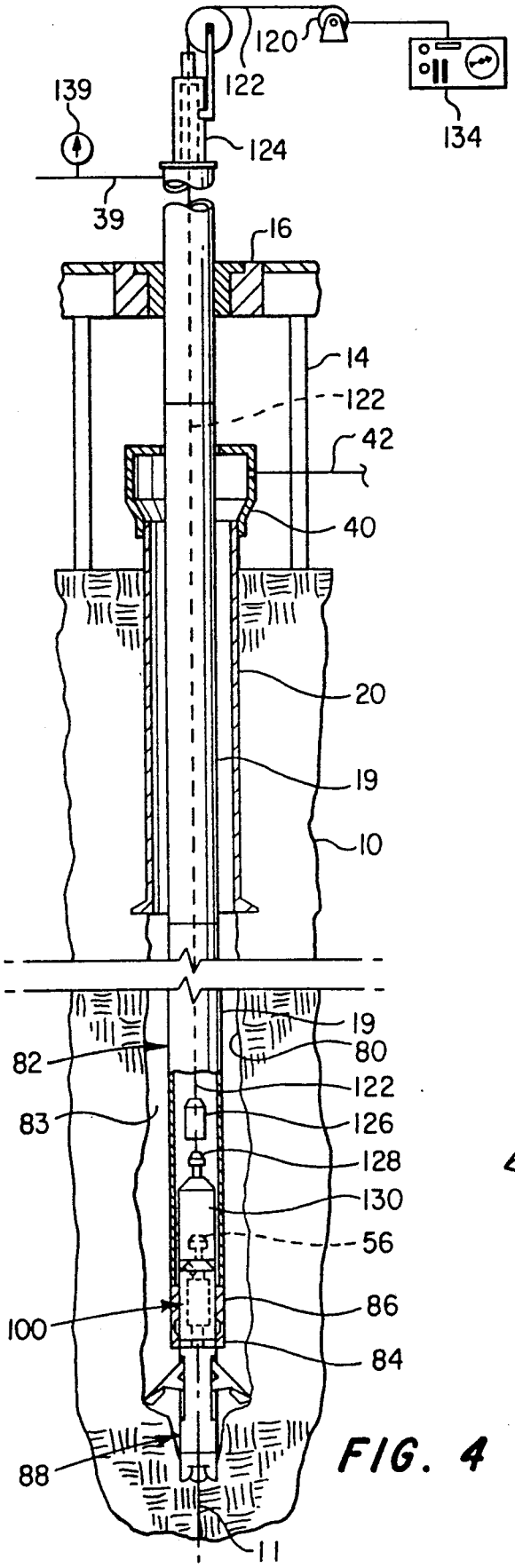
FIG. 4 is a view similar to FIG. 1 showing a well being drilled in accordance with an alternate embodiment of the present invention.
Figure 5:
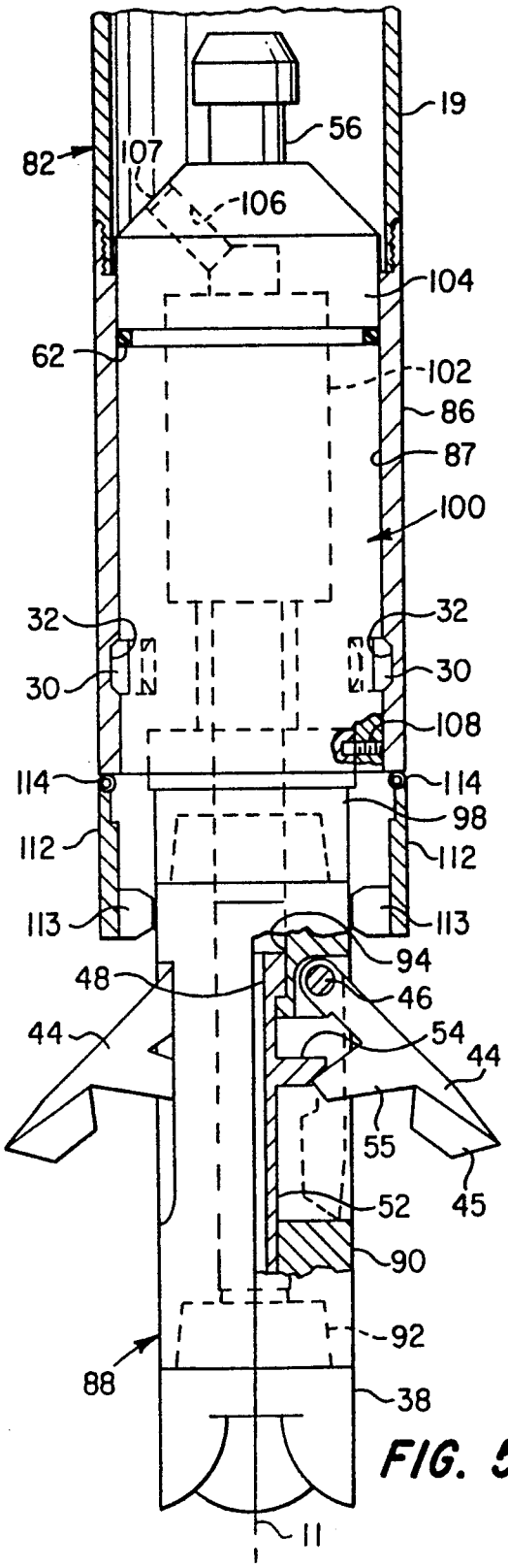
FIG. 5 is a detail view of a retrievable bit and motor assembly used in the embodiment of FIG. 4.

Referring now to FIGS. 4 and 5, an alternate embodiment of the present invention is illustrated. In FIG. 4 a wellbore 80 is being formed in the formation 10 below a surface pipe or casing 20 by a drillstem 82 comprising end-to-end coupled sections of drill pipe or casing 19 having a lower distal end 84 including a sub 86. The sub 86 is adapted to receive and operably connect a retrievable motor-driven bit assembly 88 to the drillstem 82. The drillstem 82 also extends from a drill rig 14 although the rotary table 16 may not be required for rotation of the drillstem except for directional control. Drilling fluid is circulated through the drillstem 82 from a supply conduit 39 and is returned through the wellbore annulus 83 to a diverter 40 and return line 42. The drillstem 82 is similar to the drillstem 18 of the embodiment of FIG. 1 except that it is not continuously rotated in the wellbore 80 during drilling thereof and typically is to be left in the wellbore as the wellbore casing or liner after completion of drilling operations.

As shown in FIG. 5, the bit assembly 88 includes a generally cylindrical body 90 to which may be detachably secured the bit member 38 such as by a threaded coupling 92 similar to the coupling 40. The body 90 is similar to the body 28 in that it is adapted to support one or more of the radially-deployable arms 44 pivotally supported on the body at pivot means 46. A piston 48 is also axially movable in the body 90 in a bore 94 for moving the arms 44 into their deployed and wellbore-cutting positions in response to pressure fluid acting thereon. The upper end of the body 90 is modified from that of the bit assembly 22 by having a threaded pin portion 96 which is threaded into the distal end of a rotatable shaft 98 comprising the output shaft of a downhole fluid-driven motor assembly 100. The motor assembly 100 includes a suitable fluid-driven motor 102 disposed in a body member 104 and operable to receive pressure fluid through an inlet passage 106 to rotatably drive the shaft 98. Spent fluid leaves the motor 102 through a suitable passage 110 in the shaft 98 and which is in communication with the bore 94.

The motor assembly 100 includes opposed locking dogs 30 which are engaged with the sub 86 in cooperating recesses or keyways 32 similar to the arrangement of the recesses in the sub 26. As shown in FIG. 5, the motor assembly 100 also has a fishing neck 56 formed on the upper end thereof for use in deploying and/or retrieving the motor assembly and the bit assembly 88 with respect to the drillstem 82. The motor assembly 100 also includes a frangible closure member 107 for closing the passage 106 to prevent drilling fluid from entering the motor 102 until the motor assembly is locked in its working position illustrated in FIG. 5. Additionally, the shaft 98 is suitably secured to the body 104 by a shear pin 108 to prevent rotation of the bit assembly 88 by the motor 102 until a predetermined pressure of the motor operating fluid is operable to effect rotation of the shaft 98. In this regard, once the frangible closure member 107 has ruptured and pressure fluid has entered the motor 102, at least a portion of this fluid will pass on into the passage 110 and the bore 94 to effect actuation of the piston 48 to radially deploy the arms 44 prior to rotation of the bit upon shearing of the pin 108. In this way premature rotation of the bit assembly 88 is prevented during insertion of the bit assembly into its working position illustrated in FIG. 5.

Referring further to FIG. 5, the sub 86 is provided with a closure comprising opposed semi-circular closure members 112 which are hinged to the lower end of the sub 86 and are operable to close over the bore 87 of the sub 86 upon withdrawal of the bit assembly 88 from the sub to prevent wellbore fluids from entering the interior of the drillstem. The closure members 112 are suitably hinged to the sub 86 by spring-biased hinges 114 which are operable to bias the closure members to the closed position. The closure members 112 are held in the open position shown in FIG. 5 upon entry of the bit assembly 88 into the bore 87 by suitable bearing pads 113 which bear against the cylindrical outer surface of the body 90 during its rotation without any adverse effects.

Referring again to FIG. 4, the retrievable components comprising the assembly of the bit assembly 88 and the motor assembly 100 may be retrieved from the lower end 84 of the drillstem 82 without withdrawal of the drillstem from the wellbore 12 by a wireline apparatus including a powered cable drum 120, and an elongated, flexible, braided or reinforced electric line or cable 122 which may be deployed by way of a lubricator 124 down through the drillstem 82. The electric line 122 has a suitable "fishing" or retrieval tool 126 disposed on the lower end thereof for engagement with the fishing neck 56 of the motor assembly 100 or for engagement with a corresponding fishing neck 128 disposed on a surveying, measurement-while-drilling or logging-while-drilling apparatus 130. The apparatus 130 is also adapted to be deployed into the interior of the drillstem 82 and secured to the housing 104 at the lower end of the apparatus 130 by latching means such as that associated with the retrieval tool 126 and described in U.S. Pat. No. 4,856,582. Accordingly, the bit and motor assembly 88, 100 may be deployed and retrieved at the same time as the apparatus 130 by use of the line 122, or the apparatus 130 may be deployed and retrieved by itself using the line 122 and the retrieval tool 126. Suitable electrical signals may be transmitted between the line 122 and the apparatus 130 or the motor assembly 100 from a surface-disposed control unit 134 which is in communication with the line 122 to provide operating signals thereto.

Operation of the embodiment of the present invention described in FIGS. 4 and 5 may be carried out as follows. If the drillstem 82 is operated in the conventional manner in the sense that the drillstem is to be withdrawn upon completion of the wellbore 80, the steps of retrieving the bit and motor assembly 88, 100 would be carried out by raising the drillstem 82 a short distance off of the bottom of the wellbore and allowing for some reciprocation or rotation during retrieval operations to avoid sticking the drillstem in the wellbore. The line 122 and the retrieval tool 126 are then lowered through the drillstem until the fishing tool contacts the fishing neck 128 and the apparatus 130 is retrieved after releasing it from the fishing neck 56 using suitable mechanism on the apparatus similar to that described in U.S. Pat. No. 4,856,582. If the apparatus 130 is not in the drillstem in the position shown, the tool 126 would then engage the fishing neck 56. If the locking dogs 30 are spring biased and are movable to disengage from the recesses 32 under a sufficient upward axial pulling force, this might be carried out using a jar assembly, not shown, or simply exerting enough effort on the line 122 to remove the bit and motor assembly 88, 100 from the sub 86. The apparatus 130 may be retrieved alone without raising the drillstem.

Upon removal of the bit and motor assemblies 88, 100 from the drillstem 82 the assemblies would be inspected, repaired or replaced as required and then run back into the wellbore through the drillstem either on the line 122 or through pumping the combined bit and motor assembly downward through the drillstem under the urging of pressure fluid. The sub 86 would preferably have the guide grooves such as the grooves 36 described for the sub 26 for guiding the locking dogs 30 into the recesses 32 once the motor housing 104 had begun to move into the bore 87 of the sub 86. Locking into place of the dogs 30 would be sensed by measuring an increase in pressure in the conduit 39 such as at pressure sensing means 139, FIG. 4, as the seal means 62 enters the bore 87.

Once the bit and motor assembly 88, 100 is locked into the position shown in FIG. 5, increasing fluid pressure in the drillstem 82 may be carried out to rupture the frangible closure 107 to effect rotation of the motor to shear the pin 108 to then allow the bit to rotate and to deploy the arms 44 into their radially-extended positions. Drilling may then be resumed in a generally conventional manner after lowering the drillstem back to the bottom of the wellbore 80.

Upon retrieval of the bit and motor assembly 88, 100 from the drillstem 82, the valve closure members 112 would normally close over the open end of the bore 87 to prevent the incursion of wellbore fluids into the drillstem during the bit and motor change operations.

In the method of the present invention wherein the drillstem 82 is to act as the well casing and is left in the wellbore 80, the operation would be basically the same as just described for the case where the drillstem 82 is eventually pulled out of the wellbore except that, upon completion of drilling of the wellbore 80, the bit and motor assembly 88, 100 would be retrieved upon lifting the drillstem 82 only a short distance off the bottom of the wellbore 80 during bit and motor retrieval operations and then the drillstem 82 would be left in the wellbore and further operations such as cementing of the annulus 83 would be carried out in a generally conventional manner.

The invention, including the arrangement of the drillstems 18 and 82 and the retrievable bit assemblies 22 and 88, as well as the retrievable motor assembly 100, provide several advantages in well drilling operations including the elimination of expensive and hazardous "tripping" of the drillstem into and out of the wellbore for changing the components such as the bit assemblies and motors as well as the measurement-while-drilling or logging-while-drilling apparatus 130. By leaving the drillstem in the wellbore, fluid influxes are minimized and the drilling and casing running operations as well as logging and surveying operations are combined into one. Moreover, using the casing 82 as the drillstring minimizes the risk of the necessity of abandoning a wellbore section in the event of a stuck drillstring, or other calamity which might affect a wellbore in which a conventional drillstring is broken or lost. The advantages of minimizing the amount of tubular components required at the drill site, and the expense and hazards associated with inserting and withdrawing drillstrings from the wellbore are particularly easily realized in wellbores drilled offshore, remote land operations or in harsh environments such as the Arctic oil fields.

Although preferred embodiments of the present invention have been described in some detail hereinabove, those skilled in the art will recognize that various substitutions and modifications may be made to the invention without departing from the scope and spirit of the appended claims.

What is claimed is:

1. Means for drilling a wellbore in an earth formation comprising:

an elongated tubular drillstem made up of end-to-end coupled sections of tubular pipe members;

a sub connected to a lower distal end of said drillstem; and a retrievable bit assembly including radially extendable and retractable cutter means for cutting said wellbore to a diameter at least slightly larger than the diameter of said drillstem, means on said bit assembly for moving said cutter means to a radially extended position for cutting said wellbore in response to the action of pressure fluid thereon and conveyed to said bit assembly through said drillstem, pressure fluid operated motor means including rotary shaft means for rotating said cutter means without rotating said drillstem in response to said pressure fluid being conveyed to said bit assembly through said drillstem, a body member and locking means on said body member cooperable with locking means on said sub for releasably locking said bit assembly to said drillstem for axial movement with said drillstem to form said wellbore, and means on said bit assembly for engagement with a retrieval tool for retrieving said bit assembly including said motor means from said wellbore without withdrawing said drillstem from said wellbore.

2. The combination set forth in claim 1 including:

means for engaging said shaft means to prevent rotation of said bit assembly until a predetermined pressure of fluid entering said motor means is reached.

3. The combination set forth in claim 1 including:

apparatus for measuring selected conditions in said wellbore insertable in said drillstem and retrievable from said drillstem without withdrawing said drillstem from said wellbore.

4. The combination set forth in claim 1 including:

seal means on said bit assembly and engageable with a borewall of said sub upon engagement of said locking means on said bit assembly with said locking means on said sub.

* * * * *